US005984662A

United States Patent [19]

Barudi et al.

[11] Patent Number: 5,984,662

[45] Date of Patent: Nov. 16, 1999

[54] KARMAN VORTEX GENERATING BURNER ASSEMBLY

[75] Inventors: Samir E. Barudi, Huntington Beach, Calif.; Gary M. Hazard, Morrisville, Vt.

[73] Assignee: Superior Fireplace Company, Fullerton, Calif.

[21] Appl. No.: 08/903,667

[22] Filed: Jul. 31, 1997

[51] Int. Cl.[6] ..... F23C 5/00; F23C 1/18; F24C 3/00

[52] U.S. Cl. ..... 431/8; 126/512; 126/92 R; 431/125; 431/354; 137/808

[58] Field of Search ..... 431/8, 354, 125, 431/126, 9, 2; 126/512, 92 R, 92 AC; 60/749; 137/803, 808, 809, 811

[56] References Cited

U.S. PATENT DOCUMENTS

| | | | |
|---|---|---|---|
| 2,941,362 | 6/1960 | Bailey | 60/749 |
| 3,618,318 | 11/1971 | Bryce | 60/749 |
| 3,760,790 | 9/1973 | Voges et al. | 126/92 R |
| 4,192,465 | 3/1980 | Hughes | 137/808 |
| 5,050,541 | 9/1991 | Kobayashi et al. | 122/235.23 |
| 5,540,583 | 7/1996 | Keller et al. | 431/8 |
| 5,551,869 | 9/1996 | Brais et al. | 431/285 |
| 5,630,320 | 5/1997 | Matsuda et al. | 60/749 |
| 5,768,886 | 6/1998 | Wang et al. | 60/749 |
| 5,819,725 | 10/1998 | Borgeson | 126/512 |

*Primary Examiner*—Ira S. Lazarus
*Assistant Examiner*—Josiah Cocks
*Attorney, Agent, or Firm*—Christie, Parker & Hale, LLP

[57] ABSTRACT

A burner assembly for use in a gas burning fireplace for producing flame patterns simulating flame patterns produced by real burning wood, and a method for producing such flame patterns. A preferably cylindrical bluff body is placed into the gas flow path from a supply line dividing the flow into a first and a second flow and generating Karman vortices within each flow. The vortices between the two flows are staggered. Each flow enters into a burner and exits through the burner ports where it is ignited to produce a flame pattern. The vortices create a rotating turbulence within each flow such that each flow has relatively steady flow portions alternating with turbulent rotating portions. This variance in the flow results in flames that have varying intensity, as well as color, and produces flame patterns simulating those produced by real burning wood.

25 Claims, 2 Drawing Sheets

KARMAN VORTEX GENERATING BURNER ASSEMBLY

BACKGROUND OF THE INVENTION

The present invention relates to a gas fireplace for producing a flame having a realistic appearance as though it was produced by real wood burning, and a method for producing such flame.

Gas fireplaces are common place in many homes today. They are able to provide the advantages of a real wood fire without the disadvantages associated with real wood burning fireplaces. The problem with most gas fireplaces is that they produce a static flame that is not realistic looking, i.e., they produce a flame which is not similar to a flame produced by actual burning wood.

Accordingly, there is a need for a gas fireplace capable of producing a realistic flame as though it was produced by actual burning wood.

SUMMARY OF THE INVENTION

There is provided in the present invention a gas operated fireplace having preferably a two-section burner or two burners. A supply source provides gas to the burner(s) through an exit orifice on a supply line. A body, preferably a bluff cylindrical body, is placed in front of the exit orifice and divides the flow of gas exiting the orifice. The flow is divided into a left flow and a right flow. The body causes vortices to be formed within each flow. These vortices are commonly referred to as Karman vortices. They are also referred to as a vortex street since there are two rows of vortices. Vortices generated are staggered between each flow. Each flow has relatively steady flow portions alternating with turbulent flow portions created by the vortices.

Each gas flow is aligned with an inlet to a burner or a burner section. As a result, one gas flow enters one burner or burner section while the other gas flow enters the other burner or burner section. Each burner or burner section has ports through which exits the gas flow for ignition.

The relatively steady gas flow alternating with turbulent rotating gas flow exiting the ports will produce a flame of varying intensity and color since the amount of gas within the turbulent flow will vary. This varying of the flame intensity and color causes the flame to have a realistic appearance.

DETAILED DESCRIPTION

Figure 1:
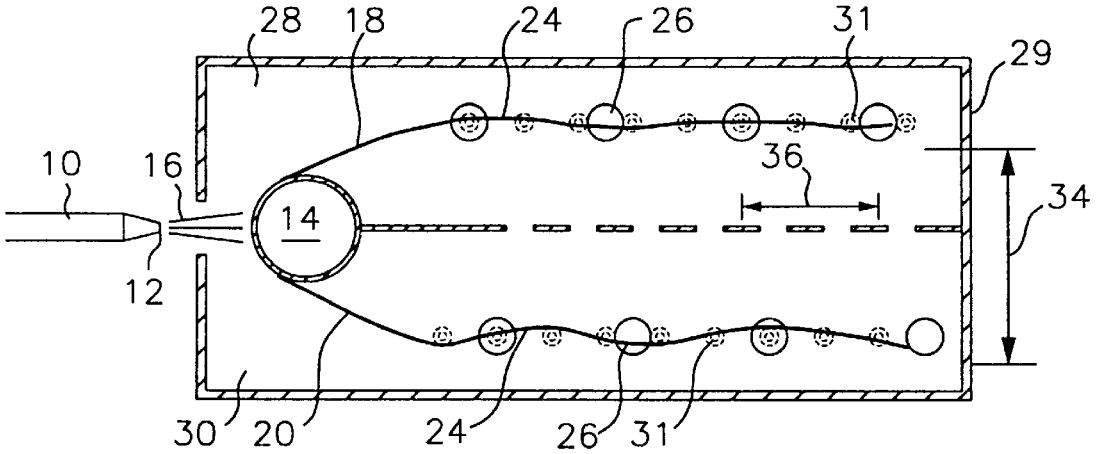
FIG. 1 depicts a Karman vortex street having two flows of Karman vortices, each flowing within a separate chamber section of a burner.
Figure 2:
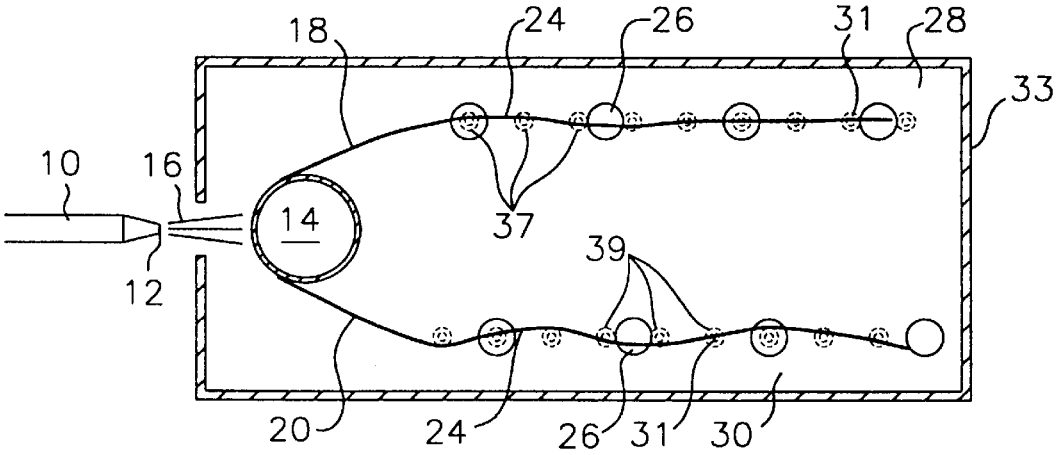
FIG. 2 depicts a Karnan vortex street having two flows of Karman vortices flowing into a single burner.

There is provided in the present invention, a gas operated fireplace for producing a realistic wood fire appearance. The gas operated fireplace typically has a gas supply line 10 for supplying the gas to a burner to be ignited for producing the flame (FIGS. 1 and 2). Typically, the gas exits the supply line through an orifice 12. Different size orifices may be used to control the velocity of the gas exiting the supply line. Gases preferably used with gas operating fireplaces include natural gas as well as LP gas.

Figure 4:
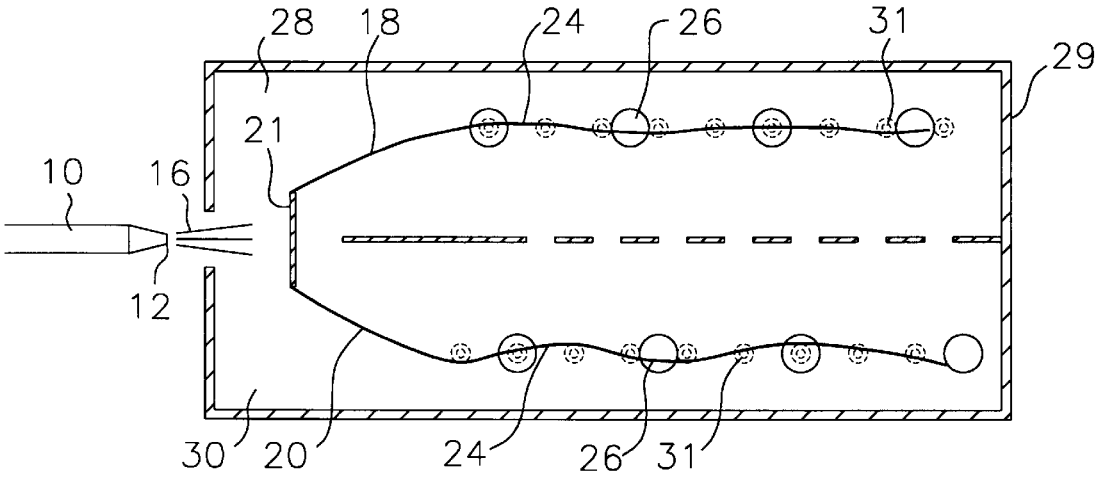
FIG. 4 depicts a Karman vortex street generated by a flat surface and flowing in a burner.

A preferably cylindrical bluff body 14 is placed in front of the exit orifice of the gas supply line. The gas flow 16 exiting the orifice strikes and partially wraps around the cylindrical surface and divides into two relatively steady flows 18, 20; one flow on either side of the surface. While it is preferred that the body is cylindrical, other longitudinal bodies having other polygonal cross-sectional shapes such as triangular or rectangular may be used. Additionally, a flat surfaces 21 may also be used (FIG. 4).

The body causes a row of vortices commonly referred to as Karman vortices to be formed on each relatively steady flow. The vortices provide for a turbulent flow due to the rotation of the gas flow. Thus, each flow has relatively steady flow portions 24 alternating with turbulent flow portions 26 due to the vortices. The relatively steady flow is also typically turbulent. However, the term "relatively steady flow" is used herein to describe this turbulent flow for the purpose of distinguishing it from the vortex created rotating turbulent flow, which is referred to herein as "turbulent flow." The double row of vortices is also commonly referred to as a vortex street.

The vortices generated are staggered between each flow. In other words, the two sides of the body alternate periodically in releasing a vortex. Each release of a vortex is also commonly referred to as "shedding an eddy." This unusual phenomenon occurs under various gas flow supply conditions including steady supply flow conditions.

To produce a realistic wood fire appearance, a burner 29 having two sections or chambers, is preferably used. For descriptive purposes, the sections will be referred as the left section 28 and right section 30 and similarly, the rows of Karman vortices will be referred to as the left row 18 and right row 20. The two-section burner is aligned to the gas flow 16 exiting the gas supply line 10 such that the left flow 18 row enters the left section 28 of the burner and the right flow row 20 enters the right section 30 of the burner 30. Each section of the burner has ports 31 through which exit the gas for ignition for producing a flame. The bluff body may be built into the burner as shown in FIG. 1.

The turbulent portions of the gas flow exiting the ports have a varying velocity which is typically different from the velocity of the relatively steady flow exiting the ports. Moreover, the quantity of gas in the turbulent flow varies. As a result, the intensity and color of the flame that is produced as the exiting turbulent flow is ignited will vary and be different from the flame produced when the relatively steady flow portion of the flow is ignited, providing for realistic looking flame pattern simulating the flame patterns produced by real burning wood. Moreover, since the Karman vortices are staggered between the rows, the flame pattern created by the right row is different from the flame pattern created by the left row. The combination of the two flames provide the appearance of a realistic wood burning fire.

Figure 3:
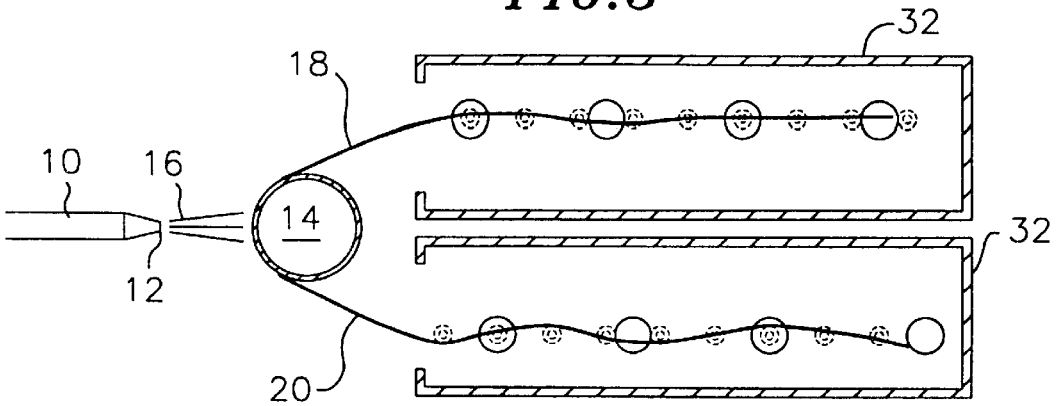
FIG. 3 depicts a Karnan vortex street having two flows of Karman vortices, each flowing within a separate burner.

As it will become apparent to one skilled in the art, the burner does not have to have two sections. For example, a single burner 33 (FIG. 2) can be used having left and right sets of exit ports 37, 39 allowing for the exit of the left and right gas flows, respectively, containing the Karman vortices. Similarly, two separate burners 32 may be used (FIG. 3).

The frequency of the shedding of the eddies or vortices is a function of the Reynolds number (Re) of the body which generates the vortices. Re is defined as the ratio between the fluid velocity and the shear velocity of a fluid. Regular, perfectly periodic eddy shedding occurs in the range of Re of 50–300 for cylindrical bodies. Above an Re of 300, a degree of randomness begins to occur in the shedding and the randomness becomes progressively greater as Re increases, until finally the wake is completely turbulent. The highest Re at which some slight periodicity is still present in the turbulent wake is about $10^6$. Periodicity is preferred within each gas flow because it results in a variable gas flow which has relatively steady flow portions and turbulent portions which provide for a flame pattern having a realistic wood burning appearance.

A infinitely long vortex street is stable to small disturbances, predictable, and not random, so as to have periodicity when the spacing of the vortices is such that:

$$h/a=0.281 \quad (1)$$

frequency and periodicity for producing a realistic flame. The various values of cylinder diameter and fluid velocity evaluated are provided in Table 1. The highlighted values are those which are the most preferred. As can be seen in the case of natural gas, the preferred frequency within a gas flow in a vortex street is 0.126 $sec^{-1}$, while for LP gas it is 0.315 $sec^{-1}$. The preferred period for both types of gas is 9.52 inches.

TABLE 1

| gas type | viscosity [lbm/ft − s] | density [lbm/ft3] | velocity [ft/s] | cylinder diameter [inch] | Re Number [1] | frequency [1/s] | period [inch] | h [inch] |
|---|---|---|---|---|---|---|---|---|
| natural | 7.6E − 06 | 0.6 | 42 | 2 | 5.5E + 05 | 52.92 | 9.52 | 16.19 |
| natural | 7.6E − 06 | 0.6 | 1 | 1 | 6.6E + 03 | 2.52 | 4.76 | 8.10 |
| natural | 7.6E − 06 | 0.6 | 0.25 | 0.5 | 8.2E + 02 | 1.26 | 2.38 | 4.05 |
| natural | 7.6E − 06 | 0.6 | 0.15 | 0.25 | 2.5E + 02 | 1.512 | 1.19 | 2.02 |
| natural | 7.6E − 06 | 0.6 | 0.25 | 2 | 3.3E + 03 | 0.315 | 9.52 | 16.19 |
| natural | 7.6E − 06 | 0.6 | 0.1 | 2 | 1.3E + 03 | 0.126 | 9.52 | 16.19 |
| natural | 7.6E − 06 | 0.6 | 1 | 12 | 7.9E + 04 | 0.210 | 57.14 | 97.14 |
| natural | 7.6E − 06 | 0.6 | 1 | 6 | 3.9E + 04 | 0.420 | 28.57 | 48.57 |
| natural | 7.6E − 06 | 0.6 | 1 | 2 | 1.3E + 04 | 1.260 | 9.52 | 16.19 |
| natural | 7.6E − 06 | 0.6 | 0.1 | 2 | 1.3E + 03 | 0.126 | 9.52 | 16.19 |
| l. p. | 5.5E − 06 | 1.97 | 9 | 2 | 5.4E + 05 | 11.34 | 9.52 | 16.19 |
| l. p. | 5.5E − 06 | 1.97 | 9 | 1 | 2.7E + 05 | 22.68 | 4.76 | 8.10 |
| l. p. | 5.5E − 06 | 1.97 | 9 | 0.5 | 1.3E + 05 | 45.36 | 2.38 | 4.05 |
| l. p. | 5.5E − 06 | 1.97 | 9 | 0.25 | 6.7E + 04 | 90.72 | 1.19 | 2.02 |
| l. p. | 5.5E − 06 | 1.97 | 5 | 2 | 3.0E + 05 | 6.3 | 9.52 | 16.19 |
| l. p. | 5.5E − 06 | 1.97 | 5 | 1 | 1.5E + 05 | 12.6 | 4.76 | 8.10 |
| l. p. | 5.5E − 06 | 1.97 | 5 | 0.5 | 7.5E + 04 | 25.2 | 2.38 | 4.05 |
| l. p. | 5.5E − 06 | 1.97 | 5 | 0.25 | 3.7E + 04 | 50.4 | 1.19 | 2.02 |
| l. p. | 5.5E − 06 | 1.97 | 1 | 2 | 6.0E + 04 | 1.26 | 9.52 | 16.19 |
| l. p. | 5.5E − 06 | 1.97 | 1 | 1 | 3.0E + 04 | 2.52 | 4.76 | 8.10 |
| l. p. | 5.5E − 06 | 1.97 | 1 | 0.5 | 1.5E + 04 | 5.04 | 2.38 | 4.05 |
| l. p. | 5.5E − 06 | 1.97 | 1 | 0.25 | 7.5E + 03 | 10.08 | 1.19 | 2.02 |
| l. p. | 5.5E − 06 | 1.97 | .05 | 2 | 3.7E + 03 | 0.63 | 9.52 | 16.19 |
| l. p. | 5.5E − 06 | 1.97 | .05 | 1 | 1.5E + 04 | 1.26 | 4.76 | 8.10 |
| l. p. | 5.5E − 06 | 1.97 | .05 | .05 | 7.5E + 03 | 2.52 | 2.38 | 4.05 |
| l. p. | 5.5E − 06 | 1.97 | .05 | 0.25 | 3.7E + 03 | 5.04 | 1.19 | 2.02 |
| l. p. | 5.5E − 06 | 1.97 | 0.25 | 2 | 159E + 04 | 0.315 | 9.52 | 16.19 |
| l. p. | 5.5E − 06 | 1.97 | 0.25 | 1 | 7.5E + 03 | 0.63 | 4.76 | 8.10 |
| l. p. | 5.5E − 06 | 1.97 | 0.25 | 0.5 | 3.7E + 03 | 1.26 | 2.38 | 4.05 |
| l. p. | 5.5E − 06 | 1.97 | 0.25 | 0.25 | 1.9E + 03 | 2.52 | 1.19 | 2.02 |
| l. p. | 5.5E − 06 | 1.97 | 0.125 | 2 | 7.5E + 03 | 0.1575 | 9.52 | 16.19 |
| l. p. | 5.5E − 06 | 1.97 | 0.125 | 1 | 3.7E + 03 | 0.315 | 4.76 | 8.10 |
| l. p. | 5.5E − 06 | 1.97 | 0.125 | 0.5 | 1.9E + 03 | 0.63 | 2.38 | 4.05 |
| l. p. | 5.5E − 06 | 1.97 | 0.125 | 0.25 | 9.3E + 02 | 1.26 | 1.19 | 2.02 |

where h=the spacing 34 between two opposite row consecutively staggered vortices a=the spacing (period) 36 between consecutive vortices in a given row For an Re greater than $10^3$ but less than $10^5$, the sledding frequency for a cylindrical body in low subsonic speed flow is described approximately by the equation:

$$fd/U=0.21 \quad (2)$$

$$h/a=1.7 \quad (3)$$

where f=frequency d=cylinder diameter

U=gas stream speed

The parameters for developing Karman vortex streets clearly show that fluid velocity is important. It has been estimated that the upper limit of the velocity exiting the supply line from a number 50 orifice for LP gas is about 143 feet/second, while the exit velocity of natural gas from a number 33 orifice is estimated at 42 feet/second.

Various bluff cylinder body diameters and fluid velocities were considered to ascertain the appropriate diameter and velocity values to use for generating vortices of sufficient As it will be apparent to one skilled in the art, as the geometries of the bluff bodies generating the vortices change, so would the required gas flow velocities for producing Karman vortices having appropriate frequencies for producing realistic wood fire flame patterns.

Having now described the invention as required by the patent statutes, those skilled in the art will recognize modifications and substitutions to the elements of the embodiments disclosed herein. Such modifications and substitutions are within the scope of the present invention as defined in the following claims.

We claim:

1. A gas fireplace comprising:

a gas supply having an exit orfice;

a body surface in line to the exit orfice for dividing a flow of gas exiting from the exit orifice and generating Karman vortices, the gas flow being divided into a first and a second flow having Karman vortices forming a Karman vortex street; and a combustion chamber having an opening into a room in which the fireplace is located;

a first burner located in the combustion chamber for receiving at least one of the divided gas flows comprising the Karman vortices, the burner having at least a port to allow for the exit of the at least one of the divided gas flows, wherein the exiting gas flow is ignited to generate a dynamic flame viewable through the combustion chamber opening.

2. A gas fireplace as recited in claim 1 wherein the burner comprises a first and a second section, wherein each section has an exit port, and wherein the first burner section receives the first gas flow and the second section receives the second gas flow.

3. A gas fireplace as recited in claim 1 further comprising a second burner, wherein the first burner receives the first gas flow and the second burner receives the second gas flow.

4. A gas fireplace as recited in claim 1 wherein the body surface is a longitudinal surface having a cross sectional shape selected from the group consisting essentially of circles, triangles, rectangles, and other polygonal shapes.

5. A gas fireplace as recited in claim 1 wherein the body surface comprises a flat surface.

6. A gas fireplace as recited in claim 5 wherein the body surface has a circular cross section with a diameter of approximately 2 inches.

7. A gas fireplace as recited in claim 1 wherein the Karman vortices in each a gas flow have a period of approximately 9.5 inches.

8. A gas fireplace as recited in claim 1 wherein the gas exiting the port is natural gas and the frequency of the Karman vortices in a flow is approximately ⅛ Hz.

9. A gas fireplace as recited in claim 1 wherein the gas exiting the port is liquid petroleum gas and the frequency of the Karman vortices in a flow is approximately ⅓ Hz.

10. A method for producing a dynamic flame in a gas fireplace comprising the steps of:

generating Karman vortices in a gas flow;

supplying the gas flow with Karman vortices to a burner located in a fireplace combustion chamber and having at least one exit port; and igniting the gas exiting the at least one port creating a dynamic flame viewable from a room where the fireplace is located.

11. A method as recited in claim 10 wherein the step of generating comprises the step of generating a Karman vortex street by dividing a gas flow from a supply source into a first and a separate second flow, wherein Karman vortices are generated in each flow.

12. A method as recited in claim 11 wherein a burner has a first and a second section, each section having an exit port, wherein the step of supplying comprises supplying the first flow of gas to the first section and supplying the second flow of gas to the second section of the burner.

13. A method as recited in claim 11 wherein the step of supplying comprises supplying the first flow of gas to the burner having an exit port and supplying the second flow of gas to a second burner having an exit port.

14. A method as recited in claim 11 wherein the step of generating a Karman vortex street comprises the step of placing a body surface in a flow path of the gas flow from the supply source, wherein the body surface divides the gas flow into the first and second separate flows.

15. A method as recited in claim 14 wherein the step of placing comprises placing a longitudinal body having a cross-sectional shape selected from the group of shapes consisting essentially of circles, triangles, rectangles and other polygonal shapes.

16. A method as recited in claim 14 wherein the step of generating a Karman vortex street comprises the step of placing a flat surface in the flow path of the gas flow from the supply source.

17. A method as recited in claim 14 wherein the step of placing comprises placing a cylindrical body having a diameter of approximately 2 inches in a flow path of the gas flow from the supply source.

18. A method as recited in claim 11 wherein the step of generating a Karman vortex street comprises the step of generating Karman vortices within the first or second flow having a period of approximately 9½ inches.

19. A method as recited in claim 11 wherein the step of generating a Karman vortex street comprises the step of generating a Karman vortex street having a first and a second gas flow of natural gas, wherein the vortices in the first or second gas flow have a frequency of approximately ⅛ Hz.

20. A method as recited in claim 11 wherein the step of generating Karman vortices comprises the step of generating Karman vortex street having a first and a second gas flow of liquid petroleum gas, wherein the vortices in the first or second gas flow have a frequency of approximately ⅓ Hz.

21. A method as recited in claim 11 wherein the step of generating Karman vortices comprises the step of staggering the generation of vortices between the first and second flows in the vortex street.

22. A burner system for a fireplace comprising:

a gas supply having an exit orifice;

a body su rface in line to the exit orifice for dividing a flow of gas exiting from the exit orifice and generating Karman vortices, the gas flow being divided into a first and a second flow having Karman vortices forming a Karman vortex street; and a burner comprising a first and a second section, wherein each section has an exit port, and wherein the first burner section receives the first gas flow and the second section receives the second gas flow.

23. A burner system for a fireplace comprising:

a gas supply having an exit orifice;

a body surface in line to the exit orifice for dividing a flow of gas exiting from the exit orifice and generating Karman vortices, the gas flow being divided into a first and a second flow having Karman vortices forming a Karman vortex street;

a first burner for receiving the first gas flow, the first burner having an exit port to allow for the exit of the first flow; and a second burner, for receiving the second gas flow, the second burner having an exit for the exit of the second flow.

24. A method for varying the flames in a gas fireplace comprising the steps of:

generating a Karman vortex street by dividing a gas flow from a supply source into a first and a separate second flow, wherein Karman vortices are generated in each flow;

supplying the first flow of gas comprising Karman vortices to a burner first section and supplying the second flow of gas comprising Karman vortices to a burner second section wherein each section comprises an exit port; and igniting the gas exiting ports creating a flame.

25. A method for varying the flames in a gas fireplace comprising the steps of:

generating a Karman vortex street by dividing a gas flow from a supply source into a first and a separate second flow, wherein Karman vortices are generated in each flow;

supplying the first flow of gas with Karman vortices to the burner having an exit port and supplying the second flow of gas with Karman vortices to a second burner having an exit port; and igniting the gas exiting ports creating a flame.

* * * * *